US007140348B2

(12) United States Patent
Takeuchi et al.

(10) Patent No.: US 7,140,348 B2
(45) Date of Patent: Nov. 28, 2006

(54) FUEL INJECTION CONTROL SYSTEM

(75) Inventors: Yoshiaki Takeuchi, Wako (JP); Kenichi Machida, Wako (JP); Hideo Nihei, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/049,009

(22) Filed: Feb. 1, 2005

(65) Prior Publication Data

US 2005/0172933 A1 Aug. 11, 2005

(30) Foreign Application Priority Data

Feb. 9, 2004 (JP) ..... 2004-032538

(51) Int. Cl.
*F02D 41/10* (2006.01)

(52) U.S. Cl. ..... 123/326; 123/492; 123/493

(58) Field of Classification Search ..... 123/325, 123/326, 492, 493
See application file for complete search history.

(56) References Cited

U.S. PATENT DOCUMENTS 4,242,991 A * 1/1981 Scherenberg et al. ..... 123/326
4,445,483 A * 5/1984 Hasegawa ..... 123/492
4,508,074 A * 4/1985 Yamato et al. ..... 123/327
4,510,911 A * 4/1985 Otobe ..... 123/493
4,630,206 A * 12/1986 Amamo et al. ..... 123/492
4,840,156 A * 6/1989 Yamato et al. ..... 123/326
5,020,495 A * 6/1991 Plapp ..... 123/326
5,069,187 A * 12/1991 Kato et al. ..... 123/492
5,669,357 A * 9/1997 Denz et al. ..... 123/481
5,839,409 A * 11/1998 Denz et al. ..... 123/326
5,941,212 A * 8/1999 Murakami et al. ..... 123/325

FOREIGN PATENT DOCUMENTS

JP 59-226238 * 12/1984 ..... 123/493
JP 2000-130221 5/2000

* cited by examiner

*Primary Examiner*—T. M. Argenbright
(74) *Attorney, Agent, or Firm*—Hamre, Schumann Mueller & Larson, PC

(57) ABSTRACT

A fuel injection valve control to correctingly increase the fuel amount appropriately for realizing a favorable acceleration performance at the time of accelerating after a throttle full closure period is finished.

3 Claims, 6 Drawing Sheets

FUEL INJECTION CONTROL SYSTEM

FIELD OF THE INVENTION

The present invention relates to a fuel injection control system for an internal combustion engine, and particularly to a fuel injection control system for stopping the fuel injection from a fuel injection valve under predetermined conditions at the time when a throttle valve is fully closed.

BACKGROUND OF THE INVENTION

In an internal combustion engine mounted on a vehicle, it is a common practice that, when a throttle valve is fully closed, the fuel injection from a fuel injection valve is stopped under predetermined conditions, thereby contriving an improvement in fuel consumption. In addition, since it is desirable that a desired acceleration can be obtained when the throttle valve is again opened after the throttle valve is fully closed, the fuel injection amount is preferably correctingly increased when it is detected that the throttle valve has been again opened.

From this point of view, a fuel injection system for correctingly increasing the fuel injection amount has been proposed in Japanese Patent Laid-open No. 2000-130221 by setting a higher amount increase level as the fuel injection stop duration during the full closure period of the throttle valve has been longer when the full closure period of the throttle valve is finished.

Meanwhile, a part of the fuel injected from the fuel injection valve is adhered to the intake passage or the throttle valve, and the fuel thus adhered is sucked into the combustion chamber according to the operating cycle of the engine 12. Therefore, when the full closure period T (hereinafter referred to simply as full closure period) of the throttle valve during which the opening TH of the throttle valve is 0 is short, as shown in FIG. 7, the adhered residual amount F of the adhered fuel is comparatively large, but when the full closure period T is long, as shown in FIG. 8, the residual amount of the adhered residual amount F is very small. Therefore, it is comparatively effective to set the amount increase level to be larger as the fuel injection stop time during the full closure period is longer as shown in Japanese Patent Laid-open No. 2000-130221.

However, since the adhered fuel is sucked into the combustion chamber of the number of times of the intake stroke during the throttle full closure period, the suction amount is not necessarily determined only by the length of the fuel injection stop time during the full closure period.

The present invention has been made in consideration of the above problems. Accordingly, it is an object of the present invention to provide a fuel injection control system capable of an appropriate fuel amount increase correction for realizing a favorable acceleration performance at the time of accelerating after the full closure period of the throttle valve is finished.

SUMMARY OF THE INVENTION

A fuel injection control system according to the present invention resides in a fuel injection control system for an internal combustion engine, including: an injection stop judging means for stopping the fuel injection from a fuel injection valve under predetermined conditions at the time when a throttle valve is fully closed; and a fuel amount increasing and correcting means for correctingly increasing the fuel injection amount on the basis of predetermined parameters when the throttle valve is again opened after said throttle valve is fully closed, wherein the fuel injection control system includes a cycle number detecting means for detecting the number of operating cycles of the internal combustion engine during the full closure period of the throttle valve and supplying the detected number of operating cycles to the fuel amount increasing and correcting means, and the fuel amount increasing and correcting means increases the fuel injection amount more as the supplied number of operating cycles is greater.

Thus, the number of operating cycles of the internal combustion engine is detected and the fuel injection amount is correctingly increased in correspondence with the number of operating cycles, whereby a favorable acceleration performance can be obtained at the time of accelerating after the full closure period is finished, irrespectively of the length of the full closure period of the throttle valve. In addition, it suffices that the number of operating cycles is a parameter proportional to the combustion cycles of the internal combustion engine, for example, the number of times of ignition or fuel injection.

In this case, it is preferable that the fuel amount increasing and correcting means is so designed that the increase in the fuel injection amount converges into a predetermined value attendant on an increase in the supplied number of operating cycles.

In addition, the fuel injection control system may include an engine speed detecting means for detecting the engine speed and supplying the detected engine speed to the fuel amount increasing and correcting means, and the fuel amount increasing and correcting means may increase more appropriately the corrected fuel injection amount in corresponding to the supplied engine speed.

Further, it is preferable that the fuel amount increasing and correcting means correctingly increases the fuel injection amount when the change rate of the opening of the throttle valve is not less than a predetermined threshold. By this, it is possible to correctingly increase the fuel injection amount only when the driver has the intention of acceleration, and to restrain the fuel injection amount when acceleration is needless, thereby contriving an improvement in fuel consumption.

According to the fuel injection control system of the present invention, the number of operating cycles of the internal combustion engine is detected, and the fuel injection amount is correctingly increased in correspondence with the number of operating cycles, whereby a favorable acceleration performance can be obtained at the time of accelerating after the full closure period is finished, irrespectively of the length of the full closure period of the throttle valve.

DETAILED DESCRIPTION OF THE INVENTION

Now, the fuel injection control system according to the present invention will be described below by taking an embodiment and referring to the attached FIGS. 1 to 6.

Figure 1:
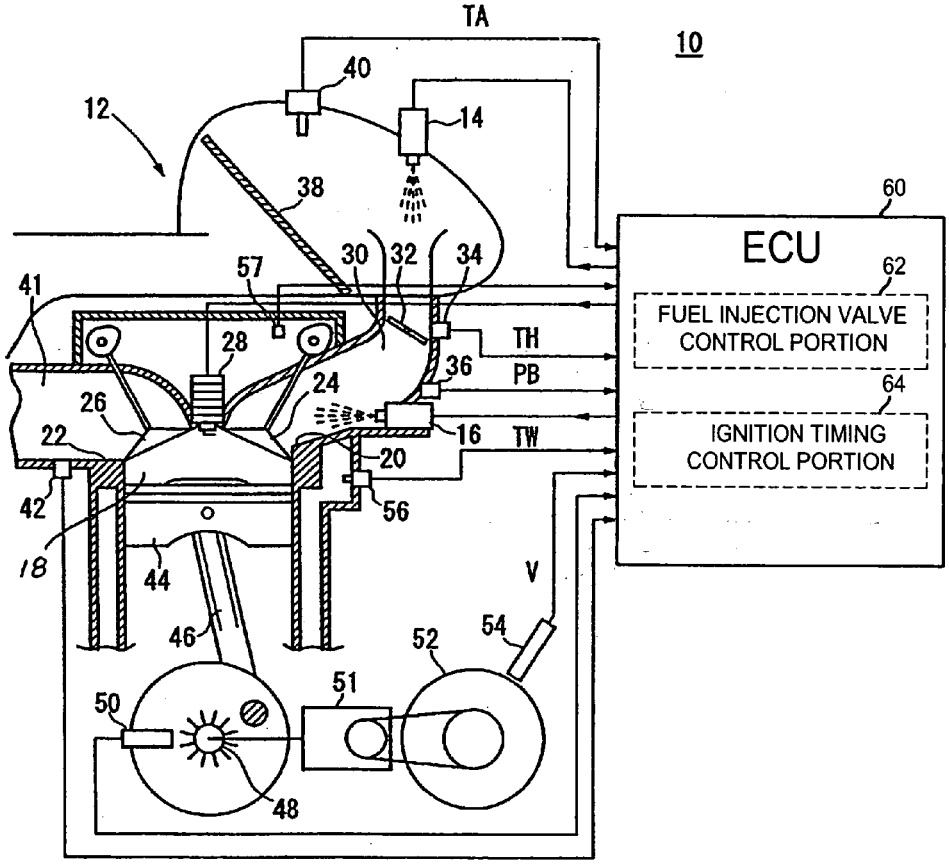
FIG. 1 is a function block diagram of a fuel injection control system according to this embodiment.

As shown in FIG. 1, the fuel injection control system 10 according to this embodiment is a system for controlling an upstream-side fuel injection valve 14 and a downstream-side fuel injection valve 16 which are provided for an engine 12 mounted on a vehicle. Examples of the vehicle with the engine 12 mounted thereon include a motorcycle.

A combustion chamber 18 of the engine 12 is provided with an intake port 20 and an exhaust port 22. An intake valve 24 and an exhaust valve 26 are provided respectively at the intake port 20 and the exhaust port 22, and a spark plug 28 is provided on the upper side of the combustion chamber 18.

An intake passage 30 communicated with the intake port 20 is provided with a throttle valve 32 opened and closed in conjunction with operations on an accelerator (not shown) so as to regulate the amount of intake air, a throttle sensor 34 for detecting the opening TH of the throttle valve 32, and a negative pressure sensor 36 for detecting the intake negative pressure PB. An air cleaner 38 including an air filter is provided at the terminal end of the intake passage 30, and the outside air is taken into the intake passage 30 through the air cleaner 38.

The intake passage 30 is provided with the downstream-side fuel injection valve 16 on the downstream side relative to the throttle valve 32, while the upstream-side fuel injection valve 14 is provided so as to be directed toward the intake passage 30 on the upstream side (the air cleaner 38 side) relative to the throttle valve 32, and an intake air temperature sensor 40 for detecting the intake air (atmospheric air) temperature TA is provided. Two oxygen concentration sensors 42 for detecting the oxygen concentration in the exhaust gas are provided in an exhaust passage 41.

A crank pulser 50 for magnetically detecting the rotation of a crankshaft 48 connected to a piston 44 of the engine 12 through a connecting rod 46 is disposed opposite to the crankshaft 48. A vehicle speed sensor 54 for detecting the vehicle speed V is disposed opposite to a wheel 52 connected with the crankshaft 48 through a six-speed transmission 51. A water jacket formed in the periphery of the engine 12 is provided with a water temperature sensor 56 for detecting the cooling water temperature TW of the engine 12. A cam sensor 57 for detecting a reference position in judging a step of opening and closing an intake valve is provided at an end portion of a camshaft in the inside of a cylinder head.

The fuel injection control system 10 according to this embodiment includes the above-mentioned sensors, and an ECU (Electric Control Unit) 60 to which the sensors are connected. The ECU 60 has a fuel injection valve control portion 62 for controlling the fuel injection amount FI (see FIG. 6) and the fuel injection timings of the upstream-side fuel injection valve 14 and the downstream side fuel injection valve 16, and an ignition timing control portion 64 for controlling the ignition of the spark plug 28 on the basis of a signal from the cam sensor 57.

Incidentally, the engine 12 is of a series 4-cylinder type, and only one cylinder portion thereof is shown in FIG. 1. Therefore, the upstream-side fuel injection valve 14, the downstream-side fuel injection valve 16, the spark plug 28 and the like are actually provided in totals of fours on the basis of each cylinder. Where the four cylinders are called a first cylinder, a second cylinder, a third cylinder, and a fourth cylinder in the order of arrangement, and the engine 12 is operated with phase shifts of 180° in the order of the first cylinder, the second cylinder, the fourth cylinder, and the third cylinder (see FIG. 3).

Figure 2:
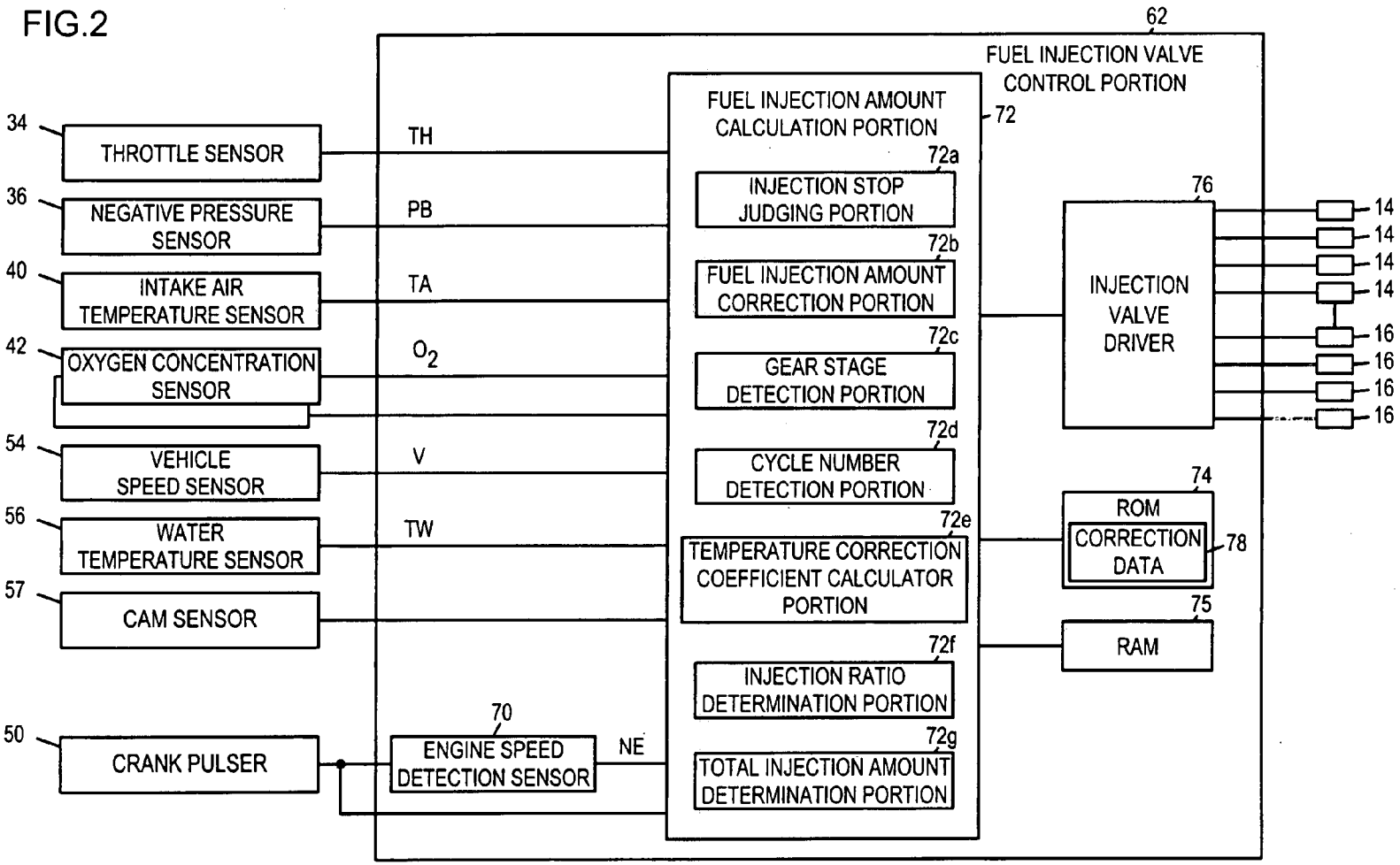
FIG. 2 is a function block diagram of the fuel injection control system.

As shown in FIG. 2, the fuel injection valve control portion 62 includes an engine speed detection portion 70 for obtaining an engine speed NE from a signal from the crank pulser 50, a fuel injection amount calculating portion 72 for obtaining the fuel injection amount FI, a ROM (Read Only Memory) 74 and a RAM (Random Access Memory) 75 as recording portions accessible from the fuel injection amount calculating portion 72, and an injection valve driver 76 for controlling the upstream side fuel injection valves 14 and the downstream-side fuel injection valves 16 based on a total injection amount and injection distribution values obtained by the fuel injection amount calculating portion 72. Correction data 78 which will be described later are recorded in the ROM 74.

The fuel injection amount calculating portion 72 is connected to the above-mentioned sensors, the engine speed detection portion, and the injection valve driver 76, and includes an injection stop judging portion 72*a* for stopping the fuel injection from the upstream-side fuel injection valve 14 and the downstream-side fuel injection valve 16 at the time of full closure of the throttle valve 32 based on the opening TH, a fuel amount increasing and correcting portion 72*b* for correctingly increasing the fuel injection amount FI when the throttle valve 32 is opened after the throttle valve 32 is fully closed, a gear stage calculation portion 72*c* for obtaining the gear stage of the transmission 51 at that time based on the vehicle speed V and the engine speed NE, and a cycle number detection portion 72*d* for detecting the number of operating cycles of the engine 12.

The gear stage calculation portion 72*c* detects at which of the first to sixth stages the gear stage of the transmission 51 is present, from the ratio between the vehicle speed V and the engine speed NE. This configuration makes it possible to detect the gear stage, without providing the transmission 51 with a shift position sensor. Besides, in the gear stage calculation portion 72*c*, the calculation of the gear stage is stopped, and an erroneous detection of the gear stage is prevented, when it is detected that the engine 12 is separated from the wheel 52, based on predetermined clutch signal and gear neutral signal.

In addition, the fuel injection amount calculation portion 72 includes a temperature correction coefficient calculation portion 72*e* for correcting the fuel injection amount FI based on the intake air temperature TA detected by the intake air temperature sensor 40 and the water temperature TW detected by the water temperature sensor 56, an injection ratio determination portion 72*f* for determining the ratio between the fuel injection amounts FI of the upstream-side fuel injection valve 14 and the downstream-side fuel injection valve 16, and a total injection amount determination portion 72*g* for determining the total fuel injection amount of the upstream-side fuel injection valve 14 and the downstream side fuel injection valve 16.

Meanwhile, in practice, a CPU (Central Processing Unit) as a main control unit includes a one-chip microcomputer integral with the ROM 74 and the RAM 75, and the functions of the fuel injection amount calculation portion 72 and the injection valve driver 76 are realized by a method in which a program recorded in the ROM 74 is read and executed by the CPU.

Figure 3:
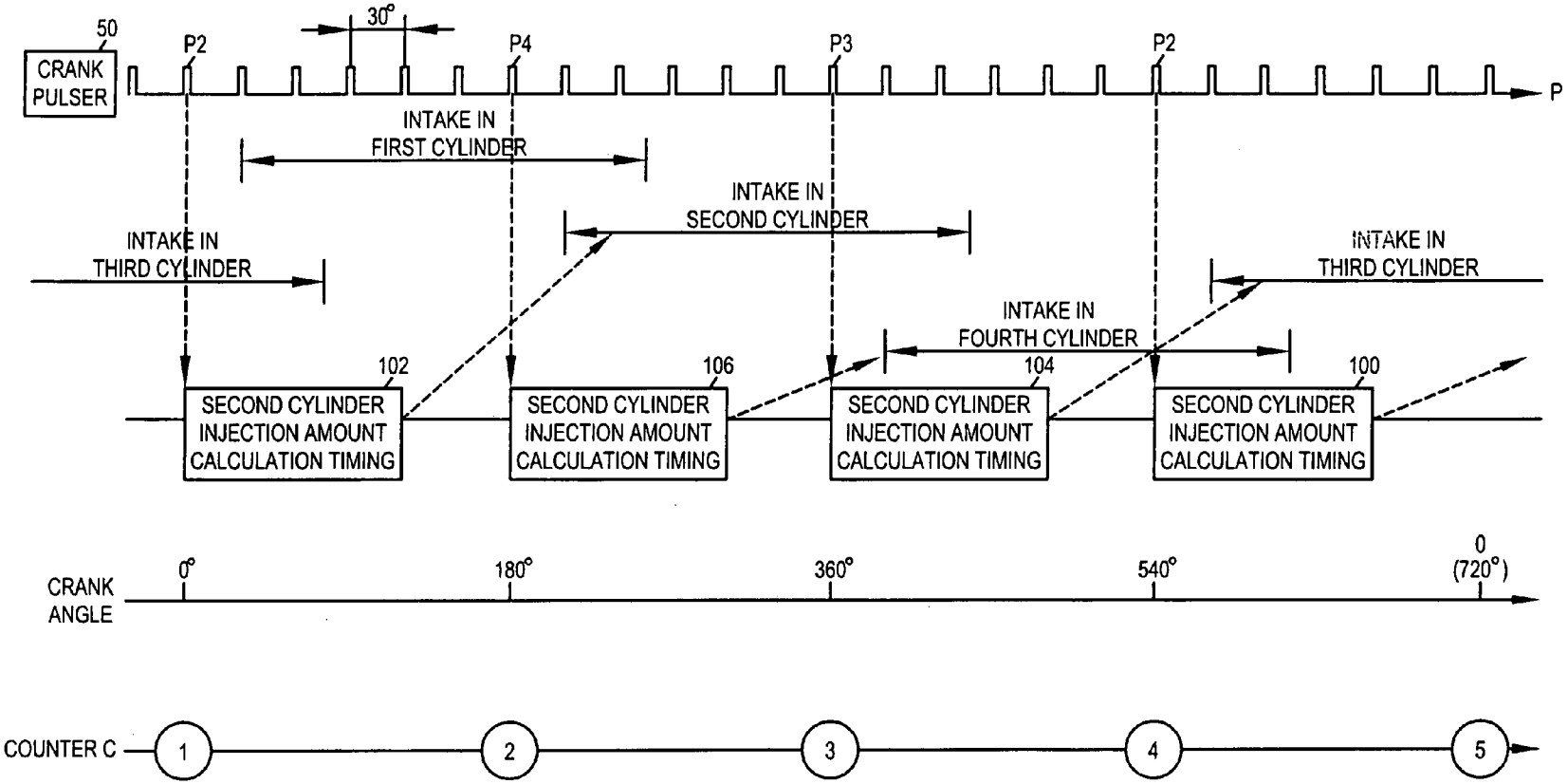
FIG. 3 is a time chart showing first to fourth cylinder injection amount calculation timings and the operations of a counter, in relation to crank angle.

As shown in FIG. 3, pulses P generated by the crank pulser 50 according to the angle θ of the crankshaft 48 are generated at intervals of 30°. In addition, where a predetermined reference angle of 0°, the intake operations in the first cylinder, the second cylinder, the fourth cylinder and the third cylinder are conducted respectively in about 30 to 240°, about 210 to 420°, about 390 to 600°, and about 570 to 60°.

The processing in the fuel injection amount calculating portion 72 is carried out when the reference pulses P2, P4, P3, and P1 at the angles θ of 0° (=720°), 180°, 360°, and 540° are generated. When the reference pulse P1 is generated, an injection amount calculation (hereinafter referred to as first cylinder injection amount calculation timing 100) for the upstream-side fuel injection valve 14 and the downstream-side fuel injection valve 16 of the first cylinder is conducted. Similarly, when the reference pulses P2, P3, and P4 are generated, calculations of the fuel injection amounts FI for the second cylinder, the third cylinder, and the fourth cylinder (hereinafter referred to as second to fourth cylinder injection amount calculation timings 102, 104, 106) are conducted, respectively. The fuel injection amounts FI calculated at the first to fourth cylinder injection amount calculation timings 100 to 106 are transmitted to the injection valve driver 76, and the fuel in the amount calculated is injected from the upstream-side fuel injection valve 14 and the down-streamside fuel injection valve 16 at the time of intake in each cylinder under the action of the injection valve driver 76.

At the second cylinder injection amount calculation timing 102, the fourth cylinder injection amount calculation timing 106, the third cylinder injection amount calculation timing 104, and the first cylinder injection amount calculation timing 100, the cycle number detection portion 72*d* counts a predetermined counter C, whereby the revolution number Cx of the crankshaft 48 can be detected. Specifically, the counter C is twice the revolution number Cx of the crankshaft 48, in other words, four times the number of combustion cycles in each cylinder. By counting the fuel injection amount calculation timing as the counter C as in this embodiment, the condition immediately before the fuel injection amount calculation for each cylinder can be obtained as a parameter, and it is possible to perform a more precise control for each cylinder.

In addition, the counter C is capable of starting, stopping, and resetting the count under the action of the cycle number detection portion, and, upon resetting, the count can be started again. Therefore, it is possible to detect the revolution number Cx of the crankshaft 48 from the time when the counter C is reset. Incidentally, the cycle number detection portion may count the counter C based on a signal from the cam sensor 57 or the number of times of ignition of the spark plug 28, other than the signal from the crank pulser 50; in other words, it suffices that the counter C is so counted as to be proportional to the number of operating cycles of the engine 12.

Figure 4:
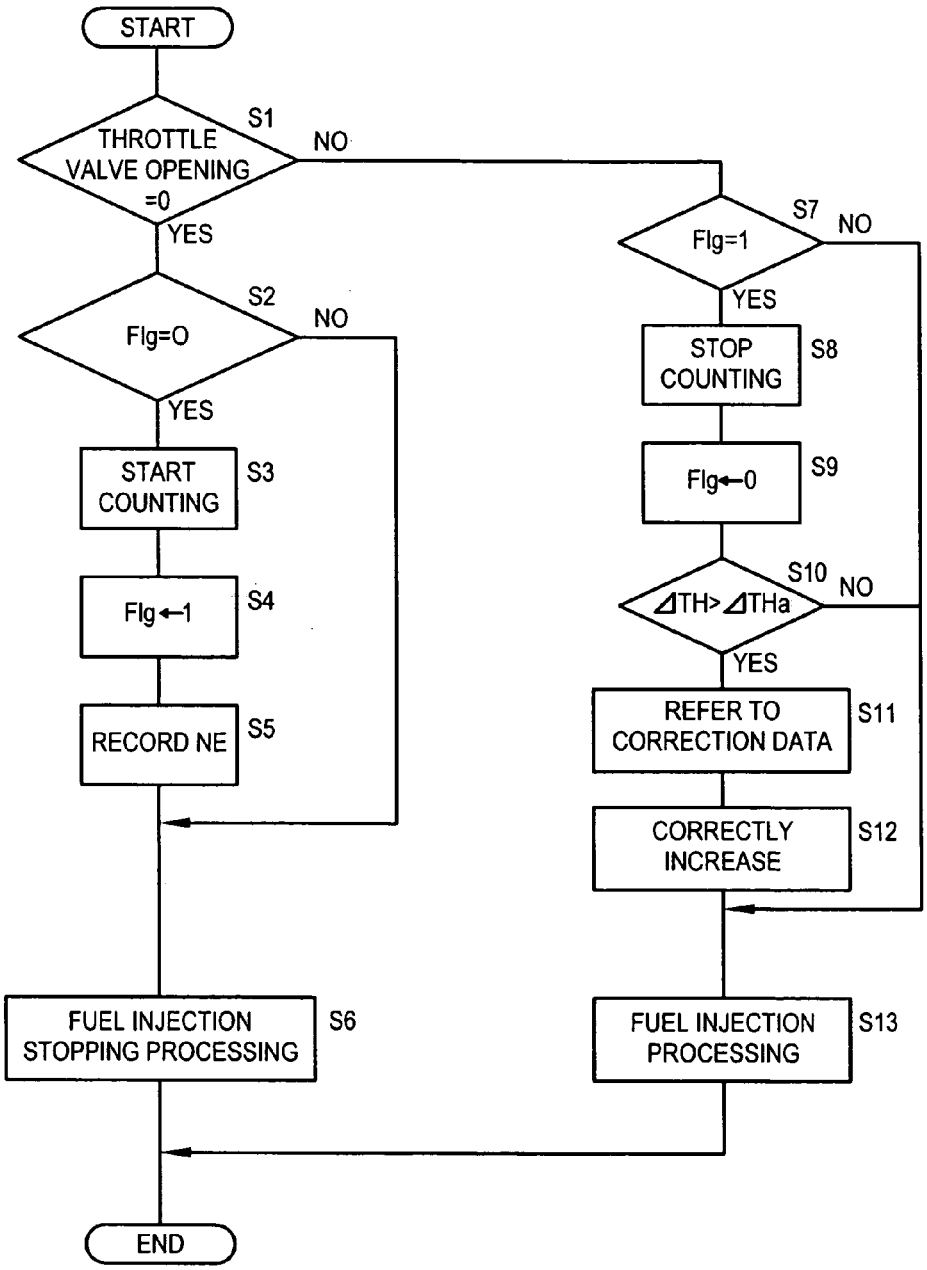
FIG. 4 is a flow chart showing the control procedure of a fuel injection control portion.
Figure 5:
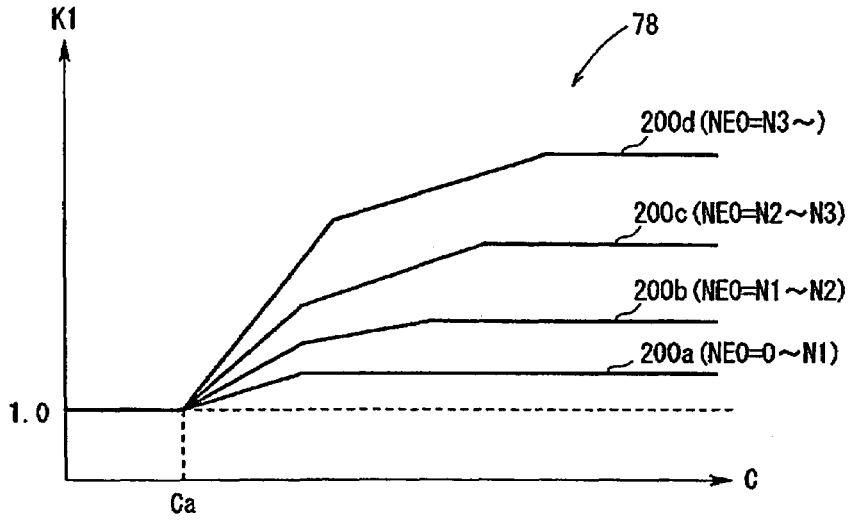
FIG. 5 is a graph showing the contents of correction data.
Figure 6:
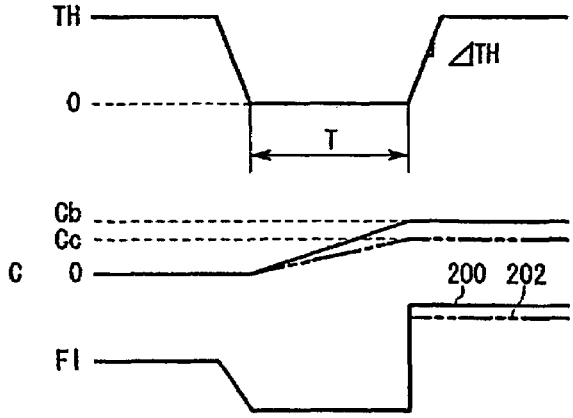
FIG. 6 is a time chart showing the opening of a throttle valve, the fuel injection amount controlled by the fuel injection control system, and variations of the counter.

Next, the procedure of the fuel injection amount control for the upstream-side fuel injection valve 14 and the downstream-side fuel injection amount 16 of the engine 12 conducted by the fuel injection valve control portion of the fuel injection control system 10 configured as above will be described below, referring to FIGS. 4 to 6.

Figure 7:
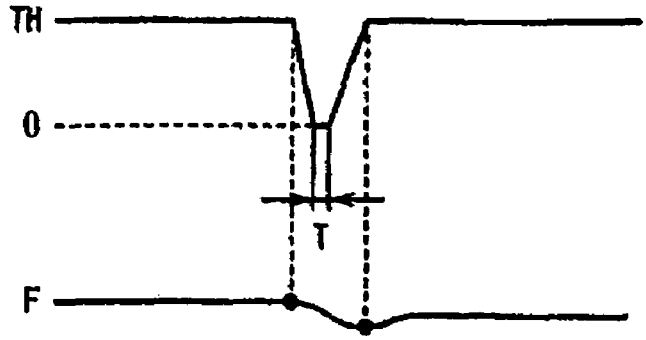
FIG. 7 is a time chart showing variations in the opening and the adhered residual fuel amount in the case where the full closure period of the throttle valve is long.
Figure 8:
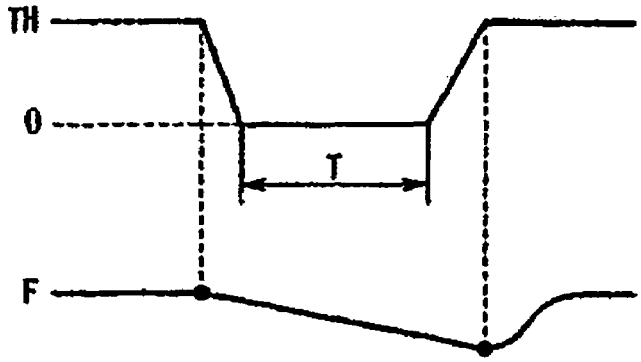
FIG. 8 is a time chart showing variations in the opening and the adhered residual fuel amount in the case where the full closure period of the throttle valve is short.

The control processing (see FIGS. 4 and 7) in the fuel injection valve control portion 62 is repeatedly conducted per tiny time mainly by the injection stop judging portion 72*a* and the fuel amount increasing and correcting portion 72*b*, and a so-called real-time processing can be performed. In addition, the fuel injection valve control portion 62 calculates the fuel injection amounts FI at different timings on the basis of each cylinder, as above-mentioned, and the procedure of calculation of the fuel injection amount FI for a typical one cylinder will be described in the following. Incidentally, in the following description, the calculation is carried out following the order of step numbers unless otherwise specified. First, in step S1, the opening TH of the throttle valve 32 is read, and it is confirmed whether or not the opening TH is 0. When the opening TH is 0 (namely, at the time of full closure of the throttle valve), step S2 is entered, whereas when the opening TH is open, step S7 is entered.

In step S2, the value of a fuel injection stop flag Flg is confirmed, and, when Flg=0, step S3 is entered, whereas when Flg=1, step S6 is entered. The fuel injection stop flag Flg is a control flag for stopping the fuel injection of the upstream-side fuel injection valve 14 and the downstream-side fuel injection valve 16 during when the throttle valve 32 is fully opened and for operating the counter C during when the throttle valve 32 is fully closed, and the fuel injection stop flag Flg is initialized to 0.

In step S3, under the action of the cycle number detection portion 72*d*, the counter C is reset to 0, and the counting of the counter C is started.

In step S4, the fuel injection stop flag Flg is set to 1. Thus, in steps S3 and S4, the counting of the counter C is started by the cycle number detection portion 72*d* when the opening TH of the throttle valve 32 becomes 0.

In step S5, the engine speed NE at that time is read, and is recorded as fuel injection stop time speed NEO in the RAM 75.

In step S6, the fuel injection at the upstream-side fuel injection valve 14 and the downstream-side fuel injection valve 16 is stopped. By stopping the fuel injection, fuel consumption can be improved. The above mentioned steps S1 to S6 are carried out principally under the action of the injection stop judging portion 72*a*, and after the processing in step S6, the current processing in the fuel injection valve control portion 62 is finished.

On the other hand, in step S7 (when the throttle valve 32 is open), the value of the fuel injection stop flag Flg is confirmed, and, when Flg=1, step S8 is entered, whereas when Flg=0, step 13 is entered.

In step S8, the counting of the counter C is stopped, and the fuel injection stop flag Flg is reset to 0 in the next step S9. Thus, in steps S7 to S9, by reference to the fuel injection stop flag Flg, it is possible to stop the counter C at the first time when the throttle valve 32 is opened, and to detect the revolution number Cx in the full closure period of the throttle valve 32.

Next, in step 10, the change rate ΔTH of the opening TH of the throttle valve 32 is obtained, and the change rate ΔTH is compared with a predetermined change rate threshold ΔTHa. When ΔTH>ΔTHa, step S11 is entered, whereas when ΔTH≦ΔTHa, step S13 is entered. That the change rate ΔTH is low means that the accelerator is operated slowly, which clearly indicates that the driver is not intending to accelerate, and it is unnecessary to correctingly increase the fuel injection amount. Therefore, when ΔTH≦ΔTHa in step S10, the executions of steps S11 and S12 for correctingly increasing the fuel injection amount FI are omitted and step S13 is entered, whereby the fuel injection amount FI is correctingly increased only when the driver is intending to accelerate. In addition, when acceleration is unnecessary, the fuel injection amount FI is suppressed, whereby it is possible to contrive an improvement in fuel consumption. Incidentally, the change rate ΔTH can be obtained as a difference in the opening TH per tiny time.

In step S11, a correction coefficient K1 for increasing the fuel injection amount FI is obtained by referring to correction data 78. As shown in FIG. 5, the correction data 78 are data for obtaining the correction coefficient K1 based on the value of the counter C at that time (namely, the revolution number Cx in the full closure period of the throttle valve 32) and the fuel injection stop time revolution number NEO recorded in step S5. Specifically, the correction coefficient K1 is obtained from graph curves 200*a*, 200*b*, 200*c*, 200*d* sectioned into four lines according to the values of the fuel injection stop time revolution number NEO and the counter C. The graph curve 200*a* corresponds to the condition where the fuel injection stop time revolution number NEO is in a low speed range of 0 to N1 [rpm], and the graph curve 200*b* corresponds to a medium speed range of N1 to N2 [rpm]. The graph curve 200*c* corresponds to a high speed range of N2 to N3 [rpm], and the graph curve 200*d* corresponds to a higher speed range of not less than N3 [rpm].

The graph curves 200*a* to 200*d* are so recorded that the correction coefficient K1 is K1=1.0 when the counter C is not more than Ca (which is a small value). When the counter C exceeds Ca, the correction coefficient K1 increases gradually, and the increase rate is gradually moderated.

When the counter C becomes not less than a predetermined value, each of the graph curves 200*a* to 200*d* converges into a fixed value. In other words, since the correction coefficient K1 is a coefficient determined in correspondence with the adhered residual fuel amount F, it is unnecessary to further increase the correction coefficient K1 after the adhered residual fuel amount F becomes 0, and by the convergence of the correction coefficient K1 to the fixed value, consumption of a needlessly large amount of fuel can be prevented. The value to which the correction coefficient K1 converges, i.e., the maximum value thereof is favorably set at a value of not more than 2.

When the counter C is not more than Ca, the reduction in the adhered residual fuel amount F is slight, and the influence of the reduction in the amount is negligible. Therefore, the region in which the counter C is not more than Ca acts as a so-called dead zone. The region of the dead zone may be set to be varied on the basis of each of the graph curves 200*a* to 200*d*.

In the region where the counter C is C>Ca, the values of the correction coefficient K1 are set to become larger in the order of the graph curves 200*a* to 200*d*.

The graph curves 200*a* to 200*d* can be obtained theoretically or empirically, and various forms of graph can be set. Namely, the graph is not limited to the graph in which the correction coefficient K1 increases uniformly according to the fuel injection stop time revolution number NEO, and it suffices that the correction coefficient K1 is set to differ depending on the characteristics of the engine 12 or the vehicle type so that the vehicle can obtain a favorable acceleration performance when the throttle valve 32 is opened. Besides, the correction coefficient K1 may be set based on a general operation pattern according to the engine speed NE.

Further, the correction coefficient K1 may be obtained by interpolation according to the fuel injection stop time revolution number NEO so that intermediate values of the four graph curves 200*a* to 200*d* can be obtained. The correction coefficient K1 may be obtained based on a predetermined empirical formula corresponding to the correction data 78.

Next, in step S12, the fuel injection amounts FI for the upstream-side fuel injection valve 14 and the downstream-side fuel injection valve 16 are correctingly increased based on the correction coefficient K1 obtained in step S11. Specifically, a usual fuel injection amount FI obtained based on the opening TH of the throttle valve 32, the negative pressure PB, the oxygen concentration $O_2$, the engine water temperature TW and the like is multiplied by the correction coefficient K1, and the fuel injection amount FI is correctingly increased according to FI←FI×K1. As has been mentioned above, the correction coefficient K1 is a value of not less than 1, and so acts as to increase the fuel injection amount FI. Besides, the correction coefficient K1 is set based on the counter C, and the value thereof is so set as to increase according to the full closure period T of the throttle valve 32. Therefore, as shown in FIG. 6, when the counter C takes a high value Cb in the full closure period T, the increase in the fuel injection amount FI is large, as indicated by solid line 202, whereas when the counter C takes a comparatively low value Cc, the increase in the fuel injection amount FI is small, as indicated by two-dotted chain line 204.

Meanwhile, even if the full closure period T is short, the number of times of intake via the intake port 20 is large and the adhered residual fuel amount F is reduced when the engine speed NE in the period is high. According to the fuel injection control system 10 in this embodiment, the correcting increase of the fuel injection amount FI when the throttle valve 32 is opened is not determined based on only the length of the full closure period T but is determined in correspondence with the counter C proportional to the number of operating cycles of the engine 12. Therefore, irrespective of the length of the full closure period T, when the adhered residual fuel amount F is small, i.e., when the value of the counter C is high, such a correction as to enlarge the increase in the fuel injection amount FI can be performed, whereby the vehicle can obtain a favorable acceleration performance. On the other hand, when the adhered residual fuel amount F is large, i.e., when the value of the counter C is low, such a correction as to suppress the increase in the fuel injection amount FI can be performed, whereby it is possible to prevent needless consumption of the fuel and to improve the fuel consumption.

In addition, since the correction coefficient K1 is obtained based on the four graph curves 200*a* to 200*d* corresponding to the fuel injection stop time revolution number NEO, it is possible to correctingly increase the fuel injection amount FI more appropriately according to the engine speed NE at the time when the throttle valve 32 is closed.

Incidentally, the correction of the fuel injection amount FI can be obtained according to FI←FI×K1×K2×K3 . . . , i.e., by multiplying the fuel injection amount FI by a correction coefficient K2 based on the intake air temperature TA calculated by the temperature correction coefficient calculation portion 72*e*, a correction coefficient K3 based on the water temperature TW, and the like, in addition to the correction coefficient K1; the other correction coefficients K2, K3 . . . are not fall in the gist of the present invention and, therefore, detailed description thereof is omitted.

In the next step S13, the fuel injection amount FI obtained is given to the injection valve driver 76 as a fuel injection command, whereby a fuel injection processing is applied to the upstream-side fuel injection valve 14 and the downstream-side fuel injection valve 16.

The above-mentioned steps S7 to S13 are executed principally under the action of the fuel amount increasing and correcting portion 72*b*, and after the processing in step S13, the current processing in the fuel injection valve control portion 62 is finished. Then, after the lapse of a predetermined time, when such conditions as the lapse of a predetermined number of cycles of the engine 12, the obtainment of a predetermined acceleration, etc. are established, the correcting increase of the fuel injection amount FI is stopped, thereby returning to the normal fuel injection control.

The fuel injection control system according to the present invention is not limited to the above-described embodiment, and various configurations may naturally be adopted without departure from the scope of the present invention.

We claim:

1. A fuel injection control system for an internal combustion engine, comprising:

an injection stop judging means for stopping the fuel injection from a fuel injection valve under predetermined conditions at the time when a throttle valve is fully closed;

a fuel amount increasing and correcting means for correctingly increasing the fuel injection amount on the basis of predetermined parameters when said throttle valve is again opened after said throttle valve is fully closed, wherein said fuel injection control system comprises a cycle number detecting means for detecting the number of operating cycles of said internal combustion engine during the full closure period of said throttle valve and supplying the detected number of operating cycles to said fuel amount increasing and correcting means, and said fuel amount increasing and correcting means increases the fuel injection amount more as said supplied number of operating cycles is greater; and an engine speed detecting means for detecting the engine speed and supplying said detected engine speed to said fuel amount increasing and correcting means, said fuel amount increasing and correcting means increasing the corrected fuel injection amount in correspondence with said supplied engine speed.

2. The fuel injection control system as set forth in claim 1, wherein said fuel amount increasing and correcting means is so set that the increase in the fuel injection amount converges into a predetermined value according to said supplied number of operating cycles.

3. The fuel injection control system as set forth in claim 1, wherein said fuel amount increasing and correcting means correctingly increases the fuel injection amount when the change rate of the opening of said throttle valve is not less than a predetermined threshold.

* * * * *